US010894200B2

(12) United States Patent
Van Horne et al.

(10) Patent No.: US 10,894,200 B2
(45) Date of Patent: Jan. 19, 2021

(54) ICE SKATE BLADE ASSEMBLY WITH RELEASABLE BLADE

(71) Applicant: VH Footwear Inc., Winnipeg (CA)

(72) Inventors: Scott Van Horne, Winnipeg (CA); Jonah Zaleznick, Memphis, TN (US)

(73) Assignee: VH Footwear Inc., Winnipeg (CA)

( * ) Notice: Subject to any disclaimer, the term of this patent is extended or adjusted under 35 U.S.C. 154(b) by 0 days.

(21) Appl. No.: 16/556,738

(22) Filed: Aug. 30, 2019

(65) Prior Publication Data

US 2020/0139219 A1 May 7, 2020

Related U.S. Application Data

(60) Provisional application No. 62/754,177, filed on Nov. 1, 2018.

(51) Int. Cl.
*A63C 1/32* (2006.01)
*A63C 1/30* (2006.01)

(52) U.S. Cl.
CPC ..... *A63C 1/303* (2013.01); *A63C 1/32* (2013.01)

(58) Field of Classification Search
CPC ..... A63C 1/303; A63C 1/30
See application file for complete search history.

(56) References Cited

U.S. PATENT DOCUMENTS 2,188,971 A * 2/1940 Adonizio ..... A63C 1/42 280/11.17
2,242,870 A * 5/1941 Prosey ..... A63C 1/30 280/11.18
4,131,288 A * 12/1978 Wilson ..... A63C 1/30 280/11.12
4,773,658 A * 9/1988 Bourque ..... A63C 1/02 280/11.12
5,332,242 A * 7/1994 Cann ..... A63C 1/30 280/11.18
5,988,683 A * 11/1999 Venier ..... A63C 1/30 280/841
6,623,017 B1 * 9/2003 Steinhauser, Jr. ..... A63C 1/00 280/11.12
8,454,030 B2 6/2013 Corbeil et al.
8,534,680 B1 9/2013 Corbeil et al.
8,550,472 B2 10/2013 Salmon et al.
(Continued)

*Primary Examiner* — John D Walters
*Assistant Examiner* — James J Triggs
(74) *Attorney, Agent, or Firm* — Ryan W. Dupuis; Ade & Company Inc; Adrian D. Battison

(57) ABSTRACT

An ice skate blade assembly for a skate, includes a blade holder that releasably receives an ice skate blade therein. The blade has first and second hooks projecting upwardly from respective first and second ends of the blade. The holder has a bridge portion with a groove to receive the main portion of the blade therein and first and second pedestals at either end of the bridge portion with cavities to receive the first and second hooks therein. An actuator mounted within the second pedestal includes a hook-receiving portion slidably movable along a curved sliding path between one end portion parallel to the longitudinal axis of the assembly in a locked position retaining the second hook thereon and an opposing released position. The actuator is recessed into the pedestal and includes a tool receiving aperture so that a tool is used to displace the actuator.

23 Claims, 6 Drawing Sheets

(56) References Cited

U.S. PATENT DOCUMENTS

| | | | | |
|---|---|---|---|---|
| 2005/0134010 | A1* | 6/2005 | Blankenburg | A63C 1/16<br>280/11.18 |
| 2013/0038031 | A1* | 2/2013 | Cruikshank | A63C 1/30<br>280/11.18 |

* cited by examiner

ICE SKATE BLADE ASSEMBLY WITH RELEASABLE BLADE

This application claims the benefit under 35 U.S.C. 119(e) of U.S. provisional application Ser. No. 62/754,177, filed Nov. 1, 2018.

FIELD OF THE INVENTION

The present invention relates to an ice skate blade assembly comprising a skate blade holder and a skate blade which can be readily released from the skate blade holder by actuating a simple trigger.

BACKGROUND

A common structure of a hockey skate is to provide skate boot to receive a foot of the user therein, a plastic blade holder mounted on the bottom of the skate boot, and a metal skate blade which releasably mounted within the blade holder so as to allow ready replacement of the skate blade without requiring removal of the foot of the user from the skate boot.

One example of a releasable skate blade is disclosed in U.S. Pat. No. 8,454,030 by Bauer Hockey, Inc. in which an actuator body is slidable displaced between an engaged position and a released position relative to a hook on the blade. The catching surface on the actuator body and the sliding direction of the actuator body are both intentionally inclined relative to the longitudinal axis of the blade at an angle of at least 35 degrees so that the biasing of the actuator body towards the engaged position acts to wedge the blade into retention within the blade holder. In this instance, the biasing member is relied upon to hold the actuator body against forces on the blade acting to release the blade from the holder. Furthermore, a large opening is provided in the blade holder to provide finger access to a trigger to release the actuator body, but the large, exposed actuating surface on the actuator block together with the forces on the blade acting against the biasing can cause the blade to be inadvertently released.

Another example of a releasable blade is disclosed in U.S. Pat. No. 8,550,472 by Multimatic Inc. in which a rotary retention latch is located within the body of the blade holder to selectively engage a hook on the blade. A release lever of the latch is accessible through a large opening in the blade holder that can be inadvertently contacted so as to cause unintentional release of the blade. A torsion spring is relied upon to maintain the rotary retention latch in the engaged position which requires a more complex assembly configuration when manufacturing the skate.

SUMMARY OF THE INVENTION

According to one aspect of the invention there is provided an ice skate blade assembly for a skate, the ice skate blade assembly extending along a longitudinal axis and comprising:

an ice skate blade having first and second ends of the blade, an ice-contacting surface extending in a direction of the longitudinal axis between the first and second ends, and an upper edge opposite to the ice-contacting surface, the upper edge comprising first and second hooks projecting upwardly proximate to one of the first and second ends respectively;

a blade holder having first and second pedestals and a bridge portion connecting the first and second pedestals, the blade holder further comprising a bottom portion having a longitudinal groove extending therealong for receiving the upper edge of the ice skate blade, the bottom portion further defining a hook-receiving recess extending upwardly from the longitudinal groove for receiving the first hook of the ice skate blade and wherein the second pedestal has an inner surface defining a cavity with a bottom aperture that opens to the longitudinal groove; and an actuator member at least partially mounted within the cavity of the second pedestal, the actuator member having a hook-receiving portion defining a hook retaining surface thereon, the hook-receiving portion being slidably movable along a sliding path between (i) a locked position, in which the hook retaining surface retains a hooking surface of the second hook of the ice skate blade thereon to lock the ice skate blade in the longitudinal groove of the blade holder, and (ii) a released position, in which the hook retaining surface does not obstruct movement of the second hook of the ice skate blade away from the blade holder to release the ice skate blade from the blade holder;

an end portion of the sliding path of the hook-receiving portion of the actuator member that is adjacent the locked position being oriented parallel to said longitudinal axis of the ice skate blade assembly; and the hook retaining surface of the hook-receiving portion of the actuator member being oriented parallel to said longitudinal axis of the ice skate blade assembly in the locked position.

In this manner, the hook retaining surface of the hook-receiving portion of the actuator member receives the hook thereon is oriented perpendicularly to the direction of release of the second hook of the blade from the blade holder. Accordingly, forces acting to remove the second hook on the blade from the blade holder do not act against the biasing member which biases the actuator member along the sliding path. The biasing member is thus isolated from forces acting on the blade so that the biasing member is not relied upon to hold the second hook in a retained position.

Preferably the hook retaining surface is oriented to perpendicularly intersect an imaginary arc that is centred at the first hook.

When the assembly further comprises a lower ledge formed on the blade holder, the lower ledge is preferably oriented parallel to the end portion of the sliding path and supports the hook-receiving portion of the actuator member engaged thereon for sliding movement between the locked and released positions. In the illustrated embodiment, one end of the lower ledge and a free end of the second hook are aligned with one another along an imaginary axis which is substantially perpendicular to said longitudinal axis of the ice skate blade assembly.

The assembly preferably further includes at least one follower element defining a follower surface protruding laterally from the hook-receiving portion of the actuator member and a lateral ledge formed on the blade holder in association with said at least one follower element in which the lateral ledge is oriented parallel to the end portion of the sliding path and supports the follower surface of the follower element thereon for sliding movement between the locked and released positions.

The at least one follower element is preferably located at one end of the hook-receiving portion of the actuator member.

The lateral ledge associated with said at least one follower element is preferably formed along a peripheral edge of an access opening in the blade holder which is open laterally to an exterior of the blade holder. The access opening associated with said at least one follower element may be a longitudinally extending slot in which the follower element occupies substantially a full height of the slot.

The assembly may include a pair of follower elements protruding outwardly from laterally opposing sides of the hook-receiving portion of the actuator member.

The recess in the blade holder which receives the first hook may be curved along a first arc with the first hook being curved along a second arc identical to the first arc such that the first hook is matingly received into the recess by pivoting of the blade relative to blade holder about a center of the first and second arcs.

The assembly preferably includes at least one access opening in the blade holder which is open laterally to an exterior of the blade holder through which the actuator member is accessed for displacing the actuator member between the locked and released positions, the hook retaining surface of the second hook being located above at least a portion of said at least one access opening. Preferably said at least one access opening overlaps the hook retaining surface of the second hook in a direction of the longitudinal axis. More particularly, said at least one access opening in the blade holder may be fully occupied by the actuator member in the locked position.

The hook-receiving portion of the actuator member may include a tool-receiving recess extending laterally inwardly from a side surface of the actuator member so as to be adapted to receive the end of a laterally oriented tool member therein, in which the tool-receiving recess is aligned with said at least one access opening throughout a range of movement of the hook-receiving portion of the actuator member between the locked and released positions thereof.

When the at least one access opening comprises a pair of access openings at laterally opposing sides of the blade holder, the tool-receiving recess may comprise a through-hole extending perpendicularly to the longitudinal axis in alignment with the pair of access openings at opposing ends of the through-hole throughout a range of movement of the hook-receiving portion of the actuator member between the locked and released positions thereof.

The actuator member may consist solely of: (i) the hook-receiving portion; and (ii) a single spring member in the shape of an arch between a first end fixedly coupled to the blade holder and a second end fixedly coupled to the hook-receiving portion of the actuator member such that the spring member biases the hook-receiving portion from the released position to the locked position.

According to a second aspect of the present invention there is provided an ice skate blade assembly for a skate, the ice skate blade assembly extending along a longitudinal axis and comprising:

an ice skate blade having first and second ends of the blade, an ice-contacting surface extending in a direction of the longitudinal axis between the first and second ends, and an upper edge opposite to the ice-contacting surface, the upper edge comprising first and second hooks projecting upwardly proximate to one of the first and second ends respectively;

a blade holder having first and second pedestals and a bridge portion connecting the first and second pedestals, the blade holder further comprising a bottom portion having a longitudinal groove extending therealong for receiving the upper edge of the ice skate blade, the bottom portion further defining a hook-receiving recess extending upwardly from the longitudinal groove for receiving the first hook of the ice skate blade and wherein the second pedestal has an inner surface defining a cavity with a bottom aperture that opens to the longitudinal groove; and an actuator member at least partially mounted within the cavity of the second pedestal, the actuator member having a hook-receiving portion defining a hook retaining surface thereon, the hook-receiving portion being slidably movable along a sliding path between (i) a locked position, in which the hook retaining surface retains a hooking surface of the second hook of the ice skate blade thereon to lock the ice skate blade in the longitudinal groove of the blade holder, and (ii) a released position, in which the hook retaining surface does not obstruct movement of the second hook of the ice skate blade away from the blade holder to release the ice skate blade from the blade holder;

the blade holder including at least one access opening therein which is open laterally to an exterior of the blade holder through which the actuator member is accessed for displacing the actuator member between the locked and released positions;

the hook retaining surface of the second hook being located above at least a portion of said at least one access opening.

By locating the hook retaining surface of the actuator member above the access opening, the actuator body can be readily configured to substantially fully occupy the access opening in the locked position of the actuator member relative to the blade so that there are minimal or no exposed edges on the actuator body within the access opening upon which objects may be caught to inadvertently release the blade.

Preferably, the at least one access opening overlaps the hook retaining surface of the second hook in a direction of the longitudinal axis.

When the hook-receiving portion of the actuator member includes a tool-receiving recess extending laterally inwardly from a side surface of the actuator member so as to be adapted to receive the end of a laterally oriented tool member therein, the tool-receiving recess is preferably aligned with said at least one access opening throughout a range of movement of the hook-receiving portion of the actuator member between the locked and released positions thereof.

According to a third aspect of the present invention there is provided an ice skate blade assembly for a skate, the ice skate blade assembly extending along a longitudinal axis and comprising:

an ice skate blade having first and second ends of the blade, an ice-contacting surface extending in a direction of the longitudinal axis between the first and second ends, and an upper edge opposite to the ice-contacting surface, the upper edge comprising first and second hooks projecting upwardly proximate to one of the first and second ends respectively;

a blade holder having first and second pedestals and a bridge portion connecting the first and second pedestals, the blade holder further comprising a bottom portion having a longitudinal groove extending therealong for receiving the upper edge of the ice skate blade, the bottom portion further defining a hook-receiving recess extending upwardly from the longitudinal groove for receiving the first hook of the ice skate blade and wherein the second pedestal has an inner surface defining a cavity with a bottom aperture that opens to the longitudinal groove; and an actuator member at least partially mounted within the cavity of the second pedestal, the actuator member having a hook-receiving portion defining a hook retaining surface thereon, the hook-receiving portion being slidably movable along a sliding path between (i) a locked position, in which the hook retaining surface retains a hooking surface of the second hook of the ice skate blade thereon to lock the ice skate blade in the longitudinal groove of the blade holder, and (ii) a released position, in which the hook retaining surface does not obstruct movement of the second hook of the ice skate blade away from the blade holder to release the ice skate blade from the blade holder;

the actuator member having at least one follower element defining a laterally protruding follower surface laterally from the hook-receiving portion of the actuator member; and the blade holder having a lateral ledge formed thereon in association with said at least one follower element in which the lateral ledge (i) is oriented parallel to an end portion of the sliding path of the hook-receiving portion of the actuator member that is adjacent the locked position and (ii) supports the follower surface of the follower element thereon for sliding movement between the locked and released positions.

Preferably, the at least one follower element is located at one end of the hook-receiving portion of the actuator member.

This configuration also allows the blade holder to be oriented in a manner to provide direct support in alignment below the hook retaining portion of the actuator member as compared to prior art configurations that require the actuator body to be cantilevered over a hook access opening in a manner which relies upon the bending strength of the actuator body to tightly retain the blade against the blade holder.

According to a further aspect of the present invention there is provided an ice skate blade assembly for a skate, the ice skate blade assembly extending along a longitudinal axis and comprising:

an ice skate blade having first and second ends of the blade, an ice-contacting surface extending in a direction of the longitudinal axis between the first and second ends, and an upper edge opposite to the ice-contacting surface, the upper edge comprising first and second hooks projecting upwardly proximate to one of the first and second ends respectively;

a blade holder having first and second pedestals and a bridge portion connecting the first and second pedestals, the blade holder further comprising a bottom portion having a longitudinal groove extending therealong for receiving the upper edge of the ice skate blade, the bottom portion further defining a hook-receiving recess extending upwardly from the longitudinal groove for receiving the first hook of the ice skate blade and wherein the second pedestal has an inner surface defining a cavity with a bottom aperture that opens to the longitudinal groove; and an actuator member at least partially mounted within the cavity of the second pedestal, the actuator member having a hook-receiving portion defining a hook retaining surface thereon, the hook-receiving portion being slidably movable along a sliding path between (i) a locked position, in which the hook retaining surface retains a hooking surface of the second hook of the ice skate blade thereon to lock the ice skate blade in the longitudinal groove of the blade holder, and (ii) a released position, in which the hook retaining surface does not obstruct movement of the second hook of the ice skate blade away from the blade holder to release the ice skate blade from the blade holder;

the sliding path of the hook-receiving portion of the actuator member being curved so as to extend longitudinally from a first end portion adjacent the locked position along an upward curvature towards an opposing second end portion adjacent to the released position.

Due to the curvature of the sliding path, the hook retaining surface on the hook retaining portion of the actuator member is sloped very slightly at a downward and forward inclination towards the second hook the hook retaining portion approaches the locked position which assists in engaging the hook retaining portion below the lower face of the hook portion of the second hook.

The first end portion of the sliding path is preferably oriented parallel to said longitudinal axis of the ice skate blade assembly.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
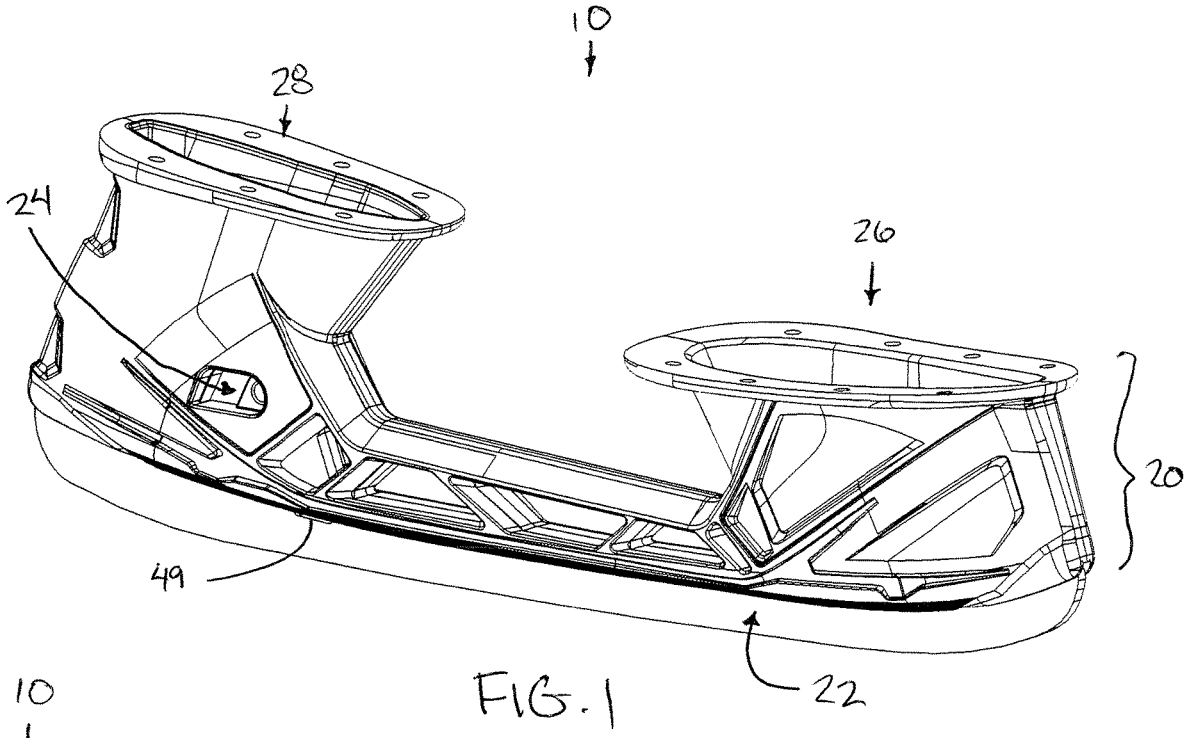
FIG. 1 is a perspective view of the skate blade assembly, showing a right side and a front of the assembly.
Figure 2:
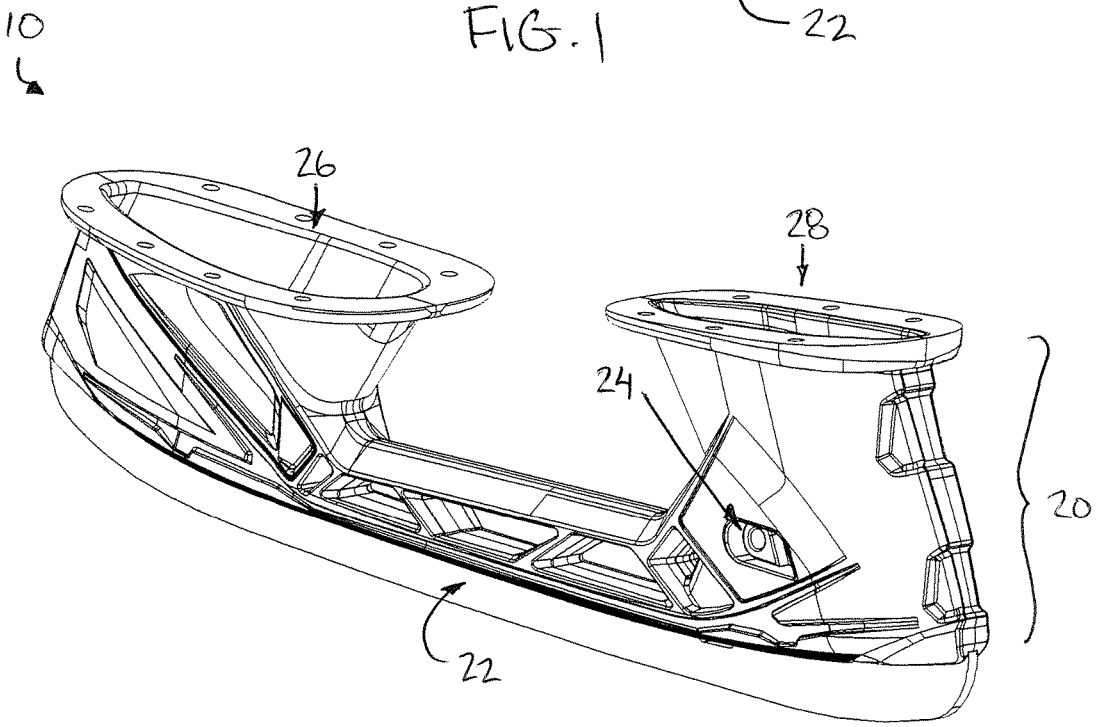
FIG. 2 is a perspective view of the skate blade assembly according to FIG. 1, showing a left side and a rear of the assembly.
Figure 3:
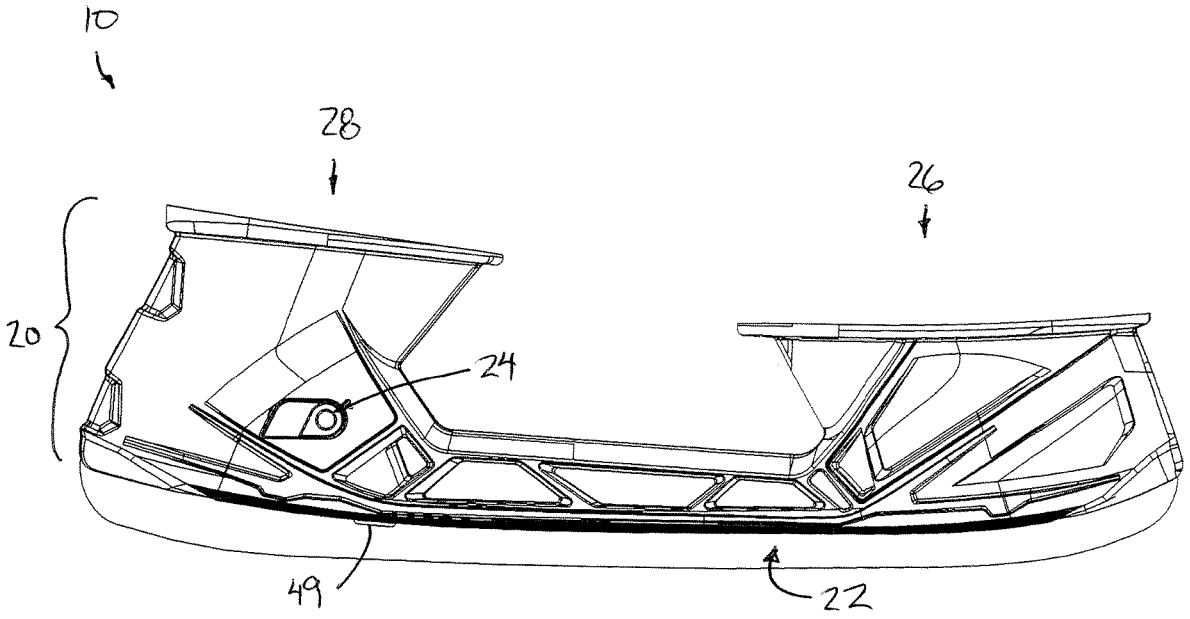
FIG. 3 is a right side elevational view of the skate blade assembly.
Figure 4:
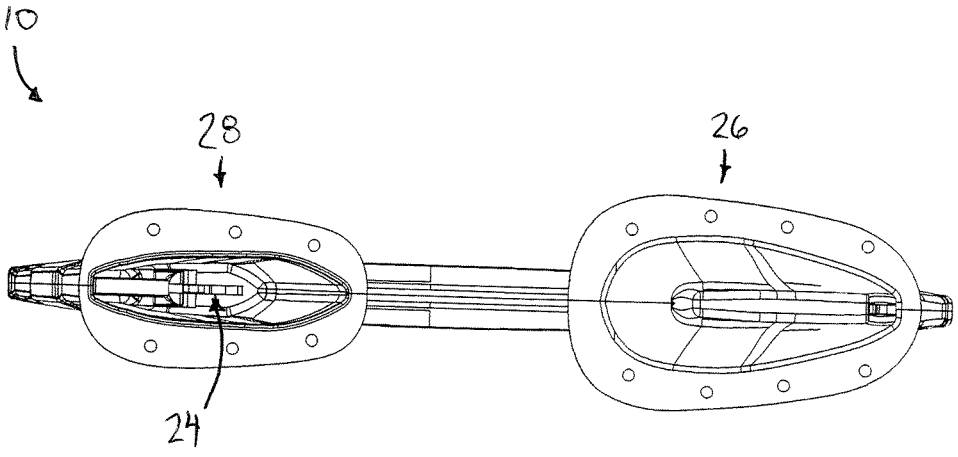
FIG. 4 is a top plan view of the skate blade assembly.
Figure 5:
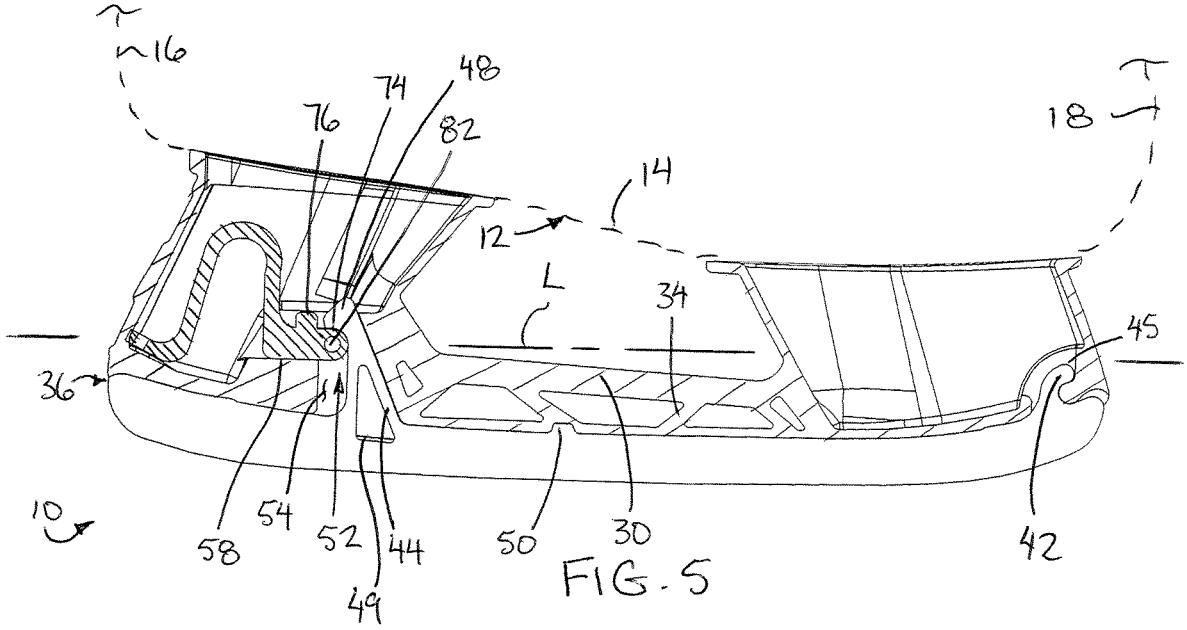
FIG. 5 is a sectional view of the skate blade assembly along a longitudinal plane indicated by line 5-5 in FIG. 4.
Figure 6:
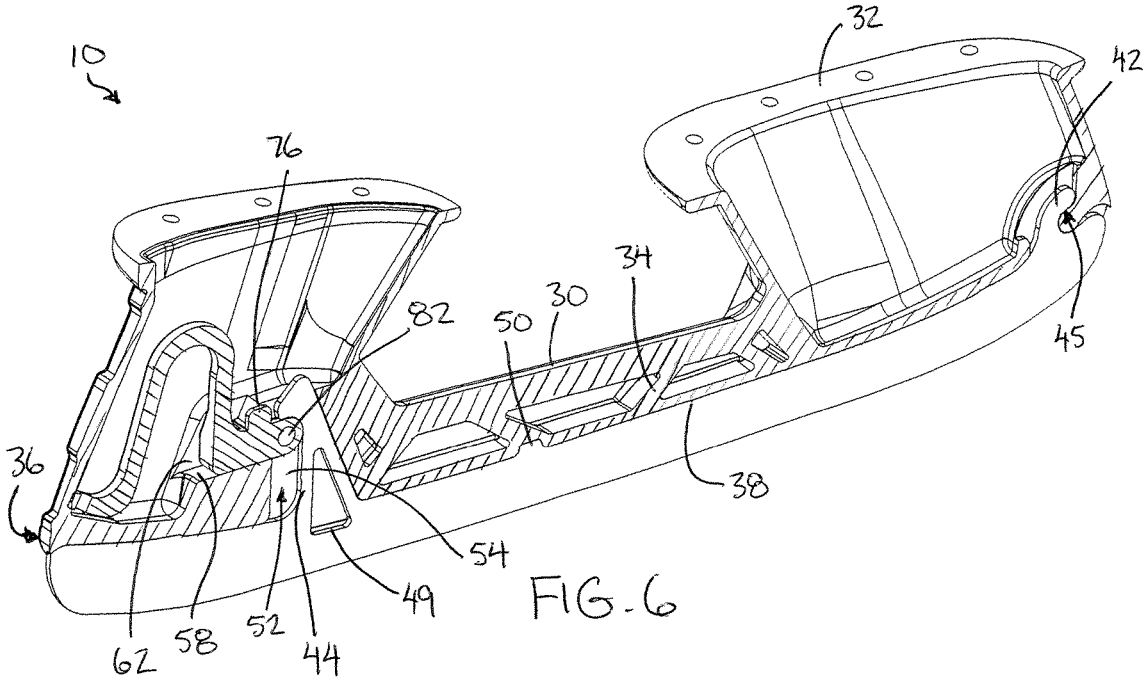
FIG. 6 is a perspective view of the skate blade assembly which has been sectioned along the longitudinal plane indicated by line 5-5 in FIG. 4.
Figure 7:
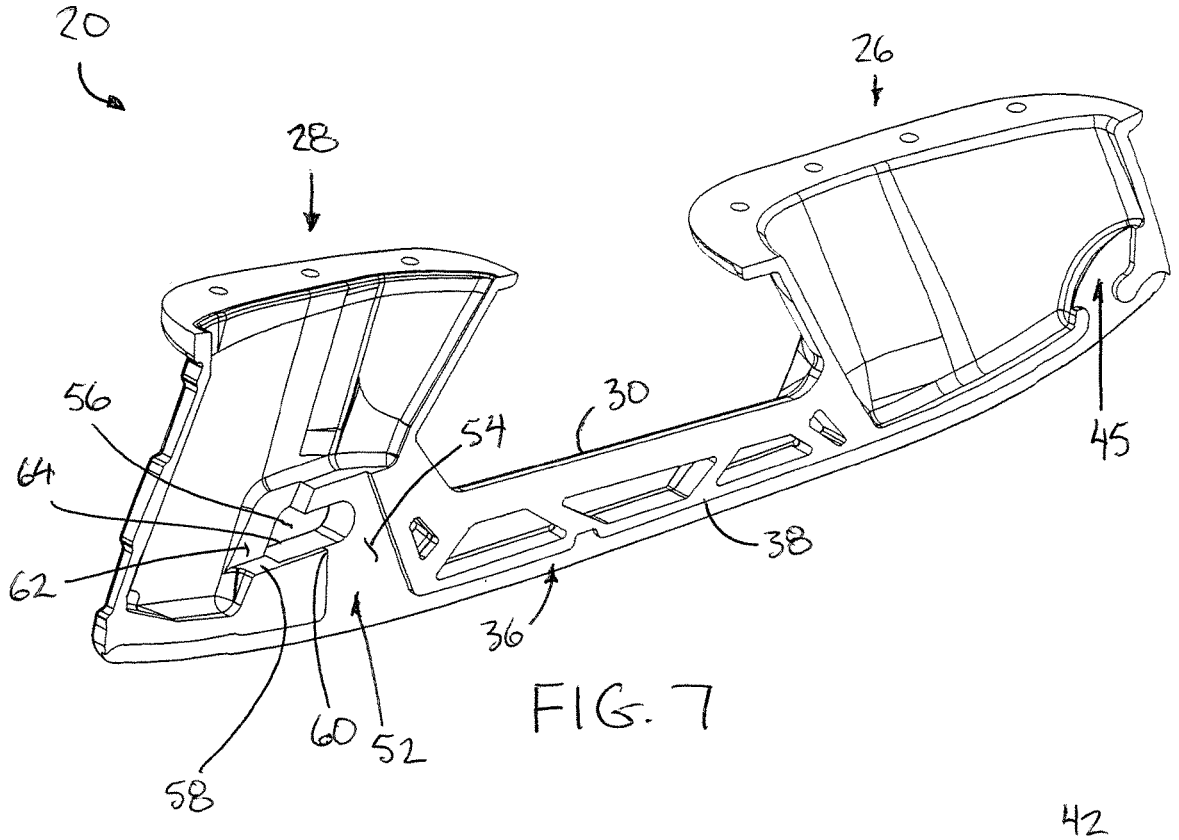
FIG. 7 is another perspective view of the skate blade assembly which has been sectioned along the longitudinal plane indicated by line 5-5 in FIG. 4, in which the actuator member and the skate blade have been removed for illustrative purposes.
Figure 8:
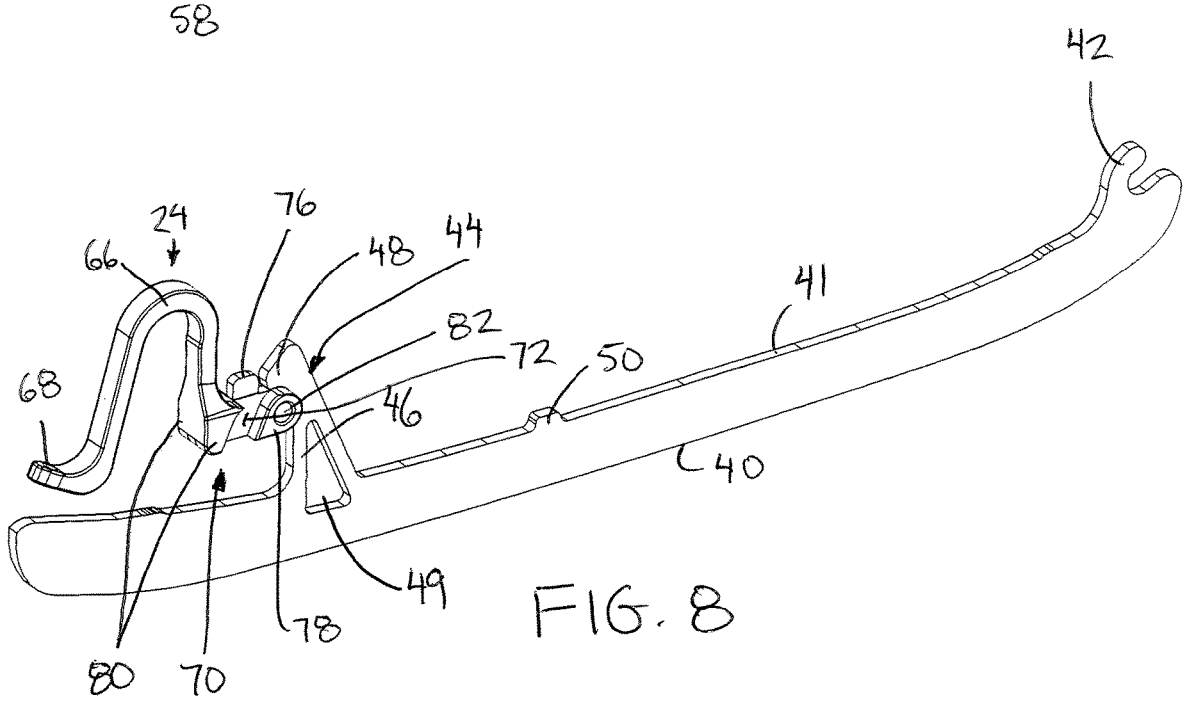
FIG. 8 is a perspective view of the actuator member and the skate blade shown removed from the blade holder of the skate blade assembly.
Figure 9:
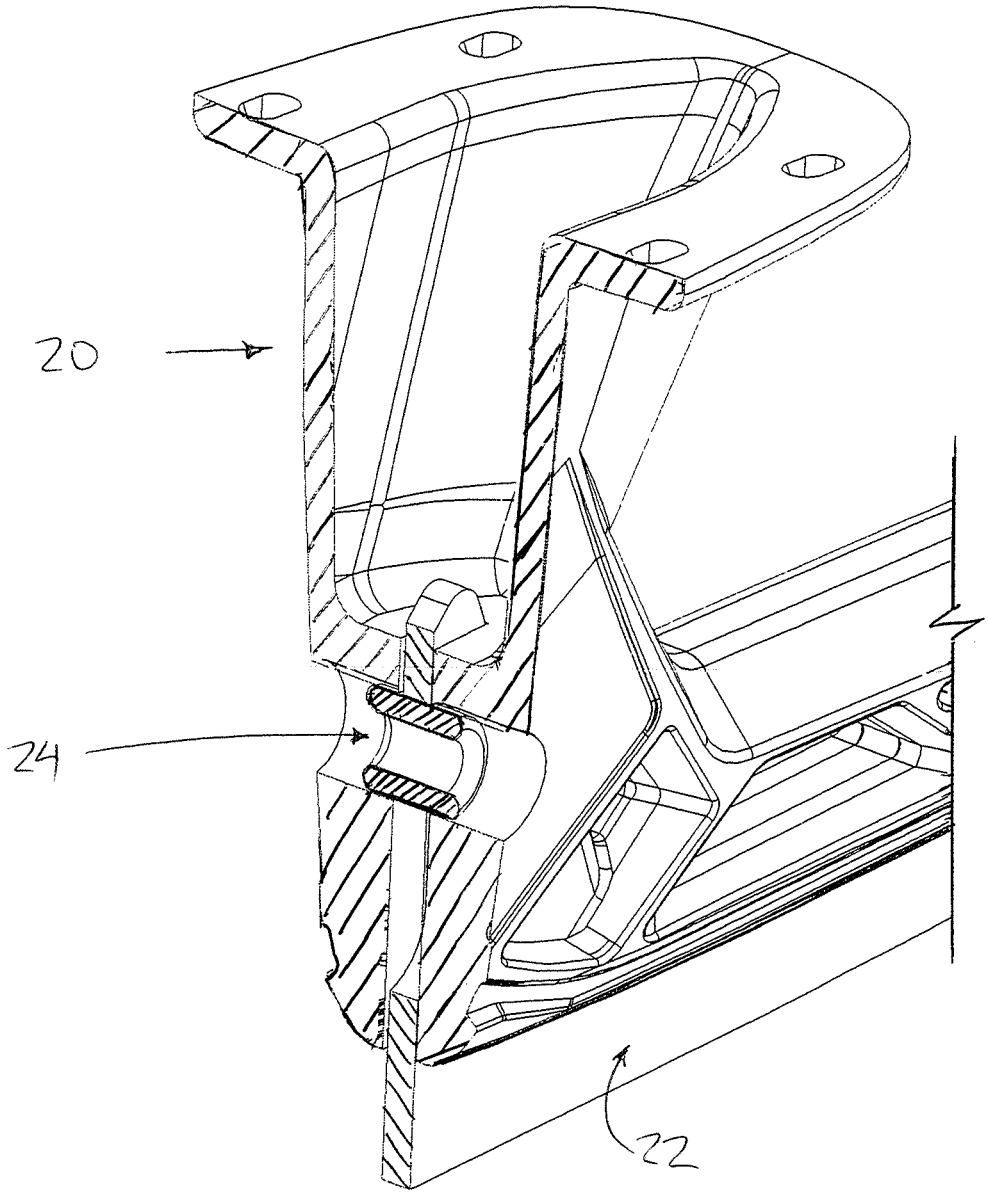
FIG. 9 is a perspective view of the skate blade assembly which has been sectioned along the longitudinal plane indicated by line 9-9 in FIG. 4.
Figure 10:
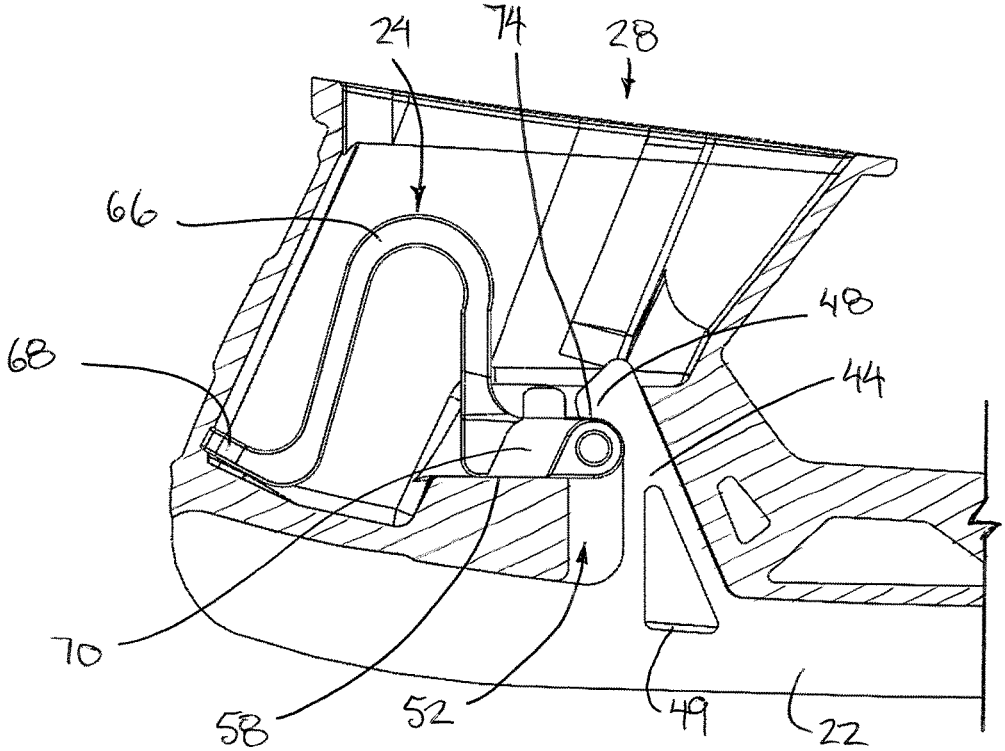
FIG. 10 is a partly sectional elevational view of the actuator member in the locked position.

Referring to the accompanying figures, there is illustrated an ice skate blade assembly generally indicated by reference numeral 10. The ice skate blade assembly is intended for use within an ice skate including a skate boot 12, represented schematically in FIG. 5, for receiving the foot of a user therein. A sole portion 14 of the skate boot 12 extends longitudinally along the bottom of the skate boot between a rear heel end 16 supporting the heel of the foot of the user thereon and a forward toe end 18 supporting the toes of the foot of the user thereon.

The ice skate blade assembly 10 according to the present invention extends along a longitudinal axis L between opposing front and rear ends of the assembly and generally includes (i) a skate blade holder 20 for being fixedly mounted on the bottom of the sole portion 14 of the skate boot, (ii) a skate blade 22 for engaging an ice surface when skating, and (iii) an actuator member 24 for selectively retaining the skate blade in a mounted position on the skate blade holder 20.

The skate blade holder 20 is a unitary moulded structure intended to be secured to the bottom of the skate boot in fixed relation, for example using mechanical fasteners such as rivets and the like. In other instances, parts of the skate blade holder may be embedded between layers of material of the skate boot as a means of fixedly retaining the blade holder relative to the skate boot.

In all instances, the blade holder generally includes a first pedestal 26 at the first toe end of the assembly and a second pedestal 28 at the second heel end of the assembly. A bridge portion 30 is joined longitudinally between the spaced apart first and second pedestals at opposing ends of the assembly. Each pedestal comprises a generally hollow column of material surrounding an internal cavity in which the perimeter wall of the pedestal surrounding the cavity is formed to be generally elongated in the longitudinal direction. An upper mounting flange 32 spans radially outward from the perimeter wall of the pedestal about the full circumference thereof which locates fastener apertures therein to receive the fasteners which secure the holder to the bottom of the skate boot according to the preferred embodiment. The perimeter walls of each pedestal taper downwardly and inwardly towards one another so that the internal cavity is reduced in cross-sectional area towards the bottom end of the pedestal. The bottom end of each pedestal is at least partially enclosed by a bottom wall 33.

The bridge portion 30 is an elongated connecting structure connected between the bottom ends of the first and second pedestals at a location spaced below the upper ends of the pedestals which are secured to the skate boot. The bridge portion 30 may include one or more openings therein separated by a plurality of intermediate struts 34 to define a truss-like structure connected between the pedestals.

A bottom portion 36 of the blade holder is formed to be continuous along the bottom of the blade holder longitudinally across the full length of the holder across both pedestals and the bridge portion therebetween. The bottom portion 36 defines a longitudinal groove 38 therein which receives an upper portion of the skate blade therein in use. The groove has an inverted U-shaped cross section so as to be open to the bottom of the blade holder along the full length thereof between the opposing first and second ends of the holder. More particularly the groove includes an upper edge and a pair of inner walls extending downwardly from the upper edge at laterally opposing sides of the upper edge, in which the inner walls are parallel and spaced apart by a thickness of the skate blade.

The skate blade 22 is formed of a flat metal plate material having a pair of laterally opposed faces which are parallel to one another. An ice contacting surface 40 is connected between the parallel faces of the plate at the bottom of the blade to span the full length of the blade between opposing first and second ends thereof corresponding to the first and second ends of the blade holder in the mounted position. The ice contacting surface 40 thus defines two edges which correspond to the intersection of the ice contacting surface with each of the two parallel faces of the plate material forming the blade. A central portion of the skate blade extends longitudinally in parallel relation with the longitudinal axis of the skate blade assembly.

The blade also includes an upper edge 41 along the top of the skate blade which is received within the longitudinal groove of the blade holder so that the upper edge of the blade abuts up against the upper edge of the groove in a mounted position of the blade within the blade holder.

The blade 22 also includes a first hook 42 extending upwardly from the upper edge 41 of the blade at a location in proximity to the forward first end of the blade but at a location spaced longitudinally inwardly therefrom, and a second hook 44 extending upwardly from the upper edge of the blade at a location in proximity to the rearward second end of the blade but at a location spaced longitudinally inwardly therefrom.

More particularly the first hook 42 extends upwardly and forwardly from the upper edge along a first arc so that the undercut area of the first hook is generally concave and defines a first radius of curvature associated with the first arc. In this instance, the first pedestal includes a hooking recess 45 in the form of a slot extending upwardly from the upper edge of the longitudinal groove in proximity to the forward first end thereof. The slot includes parallel and spaced apart side walls which are flat and spaced apart by a thickness of the skate blade. The longitudinal outermost boundary of the slot follows a convex, upward and forward curvature defining a second arc having a second radius of curvature which is identical to the first radius of curvature of the first hook. In this manner the hooking recess 45 receives the first hook therein by inserting the free end of the first hook into the slot followed by pivoting of the skate blade about an axis centred at the centre of the first and second arcs until the upper edge of the skate blade abuts the upper edge of the longitudinal groove along the full length thereof.

The skate blade also includes an intermediate lug 50 protruding upwardly from the upper edge of the skate blade at an intermediate location spaced longitudinally inwardly from each of the first and second hooks. A corresponding intermediate recess is provided in the blade holder to extend upwardly from the upper edge of the longitudinal groove in alignment with the lug 50 to receive the lug matingly therein in the mounted position of the skate blade within the blade holder. The lug 50 provides additional support to secure the skate blade relative to the blade holder in the longitudinal direction and thereby isolate the first and second hooks from some of the longitudinally oriented forces acting between the skate blade and the blade holder.

The second hook 44 includes an upright portion 46 extending upwardly from the upper edge and a hook portion 48 protruding longitudinally rearwardly or outwardly from the rear or outer edge of the upright portion 46 towards a respective rear or outer end defining a free end of the second hook. The lower face of the hook portion 48 of the second hook forms a catch referred to herein as a hooking surface which is primarily oriented to be parallel to the longitudinal axis L that the main central portion of the ice contacting surface extends; however, the hooking surface towards the free rear end of the hook portion 48 is convex so as to follow an upward and rearward curvature.

The skate blade 22 also locates a release aperture 49 in the form of a triangular cut-out within the upright portion 46 of the second hook according to the illustrated embodiment. The release aperture 49 forms an opening in the skate blade with a lower boundary that is positioned slightly below a bottom edge of the body of the skate blade holder in an assembled position of the blade within the holder. In this manner, if the skate blade is tightly wedged within the holder so that releasing the actuator member 24 by itself does not release the blade from the holder, a tool such as a flat tipped screwdriver can be inserted into the portion of the release aperture 49 protruding below the bottom of the body of the skate blade holder 20 to provide leverage by prying the blade with the tool to urge the blade out of the blade holder.

The second pedestal 28 includes a bottom opening 52 formed therein which extends through the enclosed bottom wall of the cavity in communication with the longitudinal groove in the bottom portion 36 of the blade holder. The bottom opening 52 of the second pedestal thus extends upwardly from the upper edge of the longitudinal groove 38 for alignment with the second hook received therethrough in the mounted position of the blade on the blade holder. The bottom opening 52 is bounded at laterally opposing sides by a pair of a first side wall portions 54 which are parallel and spaced apart at opposing sides of the opening so as to be coplanar with respective ones of the inner side walls of the longitudinal groove 38. The first side wall portions 54 extend upwardly into the cavity area within the second pedestal by a height which is near the overall height of the second hook and which is greater in height than the distance that the outer edge of the upright portion of the second hook spans between the upper edge of the lower blade portion of the blade and the lower face or hooking surface of the hook portion of the second hook.

Two access openings 56 are formed in the laterally opposing sides of the second pedestal in alignment with one another to form a through hole that extends laterally through the blade holder between the opposing sides thereof. The two access openings 56 overlap the bottom opening 52 of the second pedestal in the longitudinal direction of the blade holder. Each access opening 56 is an elongated slot formed in the respective side of the pedestal having opposing upper and lower boundaries which are parallel to one another and to the longitudinal axis L of the blade holder. The inner end of each access opening terminates at an intermediate location in the longitudinal direction relative to forward and rearward boundaries of the bottom opening 52 while the outer end of the access openings is situated rearwardly and longitudinally outwardly in relation to the bottom opening.

A lower ledge 58 is formed internally within the second pedestal in the form of a horizontal shelf lying parallel to the longitudinal axis L and spanning laterally between opposing sides of the second pedestal. The lower ledge is parallel and coplanar with the lower boundaries of both access openings 56. A longitudinally inner portion of the lower ledge 58 terminates at an inner edge at 60 at an intermediate location in the longitudinal direction between the forward and rearward boundaries of the bottom opening. The inner portion of the lower ledge spans between the pair of first side wall portions 54 of the bottom opening.

A longitudinally outer end portion of the lower ledge 58 towards the rear end of the holder spans laterally between a pair of second side wall portions 62 which are spaced laterally apart by a distance which is greater than the first side wall portions 54 such that each second side wall portion 62 is stepped laterally outwardly in relation to the corresponding first side wall portion at the same side of the second pedestal. The second side wall portions 62 are also parallel to one another and to the longitudinal direction of the blade holder.

A pair of lateral ledges 64 are also provided within the second pedestal so as to be parallel to the longitudinal axis L and coplanar with the lower ledge 58. More particularly, each lateral ledge protrudes laterally outwardly from a respective side of the lower ledge 58 to be coplanar with the lower boundary of a respective one of the access openings 56. The lateral ledges similarly overlap the bottom opening in the longitudinal direction of the holder.

An inner wall of the bottom opening 52 which is connected between the first side wall portions 54 at the inner or forward end of the bottom opening is oriented at a slope extending upwardly and longitudinally outwardly/rearwardly from the upper edge of the longitudinal groove which is identical to the slope of the corresponding inner edge of the upright portion 46 of the second hook such that the inner wall of the bottom opening and the inner edge of the second hook closely engage one another along the full length thereof in the mounted position of the skate blade within the holder.

Figure 11:
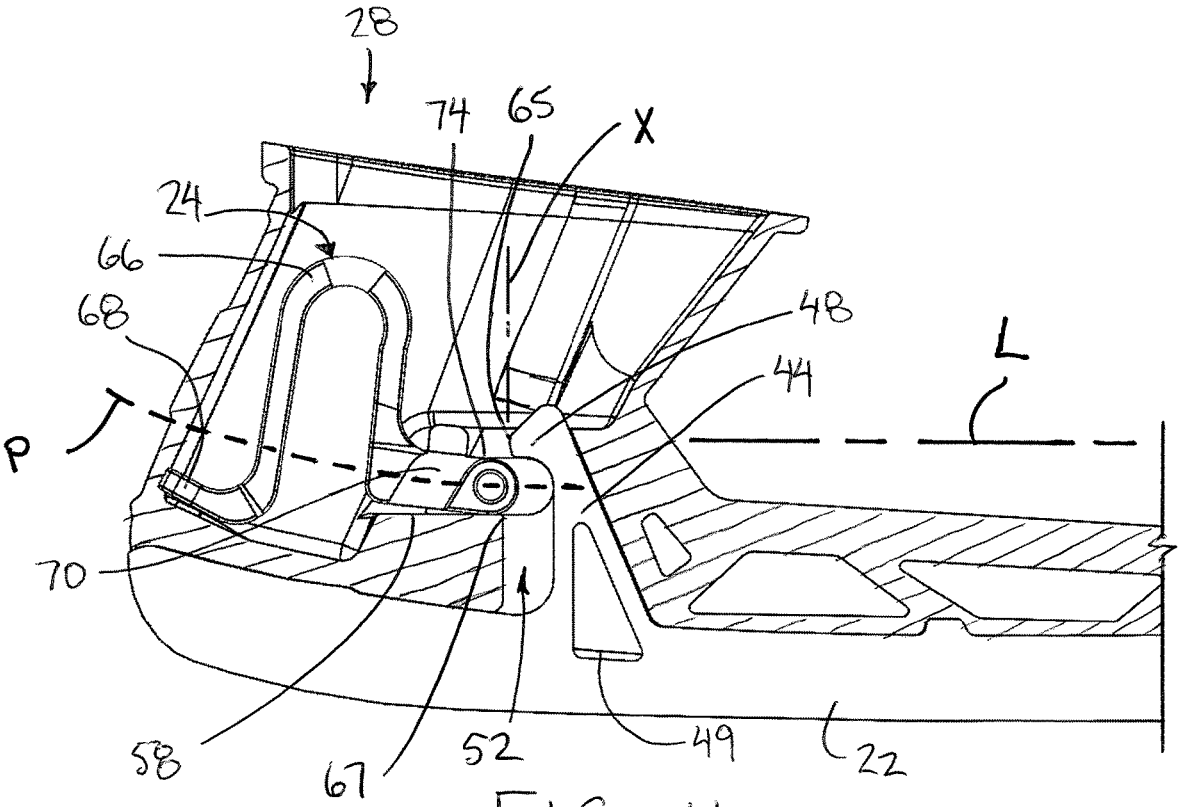
FIG. 11 is a partly sectional elevational view of the actuator member in the released position.

When the second hook is received within the bottom opening in the mounted position of the blade within the blade holder, the rear free end of the second hook 44 projects longitudinally rearwardly over top of the access openings so that the hooking surface at the lower face of the hook portion 48 of the second hook is substantially coplanar with the upper boundary of the access openings. More particularly, the rear free end of the second hook 44 is located such that an imaginary axis X connected between the rear free end 65 of the second hook and the inner forward end 67 of the lower ledge 58 lies transversely, and near perpendicularly, to the longitudinal axis L of the blade, for example such that the imaginary axis X and the longitudinal axis L in FIG. 11 are oriented at an angle of between 85 and 95 degrees relative to one another.

The actuator member 24 is received within the cavity in the second pedestal as described in the following. The actuator member consists of a single arch portion 66 in the form of an inverted U shape that defines a single spring connected between a mounting portion 68 at an outer first end of the arch and a hook receiving portion 70 at an inner second end of the arch. The mounting portion 68 is secured in fixed relation to the bottom wall of the pedestal at the rear or outer end thereof, for example using a fastener penetrated through a fastener hole in the mounting portion.

The hook receiving portion 70 is supported for longitudinal sliding movement along the lower ledge 58 of the second pedestal. The hook receiving portion includes a core body portion 72 in the form of a flat plate which is upright and parallel to the longitudinal direction having a lateral width corresponding approximately to the thickness of the skate blade between the opposing faces thereof. The core body is thus suited for being slidably received between the first side wall portions 54 within the second pedestal. A bottom edge of the core body 72 is parallel to the longitudinal direction of the blade holder and is engaged upon the lower ledge for relative sliding therebetween. An opposing upper edge of the core body locates a hook retaining surface 74 thereon at the inner end of the core body longitudinally opposite from the arch 66. The hook retaining surface 74 includes a main portion that is parallel to the longitudinal axis L to be coplanar with the lower face of the hook portion 48 received thereon in the locked position. The hook retaining surface 74 towards the forward end of the hook receiving portion is curved along a convex path downwardly and forwardly from the main portion of the hook retaining surface 74. This convex sloped end portion of the hook retaining surface 74 cooperates with the corresponding convex sloped end portion of the lower face of the hook portion 48 to pull the skate blade 22 tightly into the blade holder 20 as the hook retaining portion of the approaches the locked position relative to the second hook 44.

An upper tab 76 protrudes upwardly from the hook retaining surface 74 at a position spaced rearwardly or longitudinally outwardly in relation to the free end of the second hook. The upper tab spans the width between the first side wall portions 54 of the bottom opening at a location above the hook retaining surface of the actuator member to provide additional stability to the actuator member as the hook receiving portion is longitudinally slidable relative to the pedestal.

The hook receiving portion of the actuator member is supported to be slidable along a sliding path P between a first end portion of the sliding path adjacent to a locked position and a second end portion of the sliding path adjacent to a released position. Due to the flexing of the arch portion 66 of the actuator member 24, the sliding path of the hook receiving portion 70 of the actuator member 24 follows a slight curvature. The first end portion of the sliding path P adjacent to the locked position is parallel to the longitudinal axis L; however, the sliding path curves upwardly as it extends rearwardly and longitudinally from first end portion defining the locked position to the second end portion defining the released position of the hook receiving portion 70 relative to the second hook 44.

In the locked position, the hook retaining surface is engaged under the lower hooking surface under the hook portion of the second hook of the skate blade so as to retain the skate blade retained thereon for locking the ice skate blade in the longitudinal groove of the blade holder. By preventing downward movement of the second hook out of the blade holder, the pivotal motion required to release the first hook is prevented so that the first and second hooks collectively fix the blade relative to the blade holder. Due to the slight curvature of the sliding path P, the hook retaining surface 74 on the hook retaining portion of the actuator member 24 is sloped very slightly at a downward and forward inclination towards the second hook 44 as the hook retaining portion approaches the locked position which assists in engaging the hook retaining portion below the lower face of the hook portion 48 of the second hook 44. Once in the locked position, the hook retaining surface 74 of the hook-receiving portion of the actuator member 24 is oriented parallel to said longitudinal axis of the ice skate blade assembly.

In the released position, the hook retaining surface is longitudinally displaced together with the hook receiving portion of the actuator member rearwardly towards the outer end of the blade holder sufficiently that the hook retaining surface no longer overlaps the second hook in the longitudinal direction so that the hook retaining surface no longer obstructs movement of the second hook of the ice skate blade away from the blade holder to release the skate blade from the blade holder.

The hook receiving portion of the actuator member further includes a pair of follower elements 78 which protrude laterally outwardly from opposing sides of the core body at the innermost end thereof directly below the hook retaining surface 74. The follower elements are substantially flush with the inner end of the hook receiving portion 70 while spanning a full height between the upper and lower boundaries of the access openings 56 so that the upper and lower boundaries of the follower elements are engaged for relative sliding with the upper and lower boundaries of the access opening 56 respectively throughout the entire sliding movement of the hook receiving portion of the actuator member between the locked and released positions. The upper boundary of the follower elements are thus aligned with the hook retaining surface 74 and the hooking surface of the second hook in the locked position. More particularly, in the locked position, the follower elements provide direct support between the hooking surface of the second hook engaged thereon at the top of the follower elements and the engagement of the follower elements on the lateral ledges directly therebelow to provide positive support the inner end of the hook receiving portion of the actuator member that is directly received below the hooking surface of the second hook.

The overall lateral width occupied by the follower elements 78 is equal to or less than the lateral space between the second side wall portions 62 for ease of insertion of the actuator member into the second pedestal of the blade holder during assembly of the ice skate blade assembly.

The hook receiving portion of the actuator member further includes a pair of stabilizer lugs 80 which protrude laterally outwardly from opposing sides of the core body 72 at a rear or outer end of the core body opposite from the inner end that locates the hook receiving surface thereon. The stabilizer lugs are stepped outwardly in relation to the lateral width of the core body so as to span the full width between the pair of second side wall portions 62 within the second pedestal. The outer end faces at laterally opposed ends of the lugs 80 are flat and parallel to the longitudinal direction for being abutted in flat engagement against the second side wall portions 62 respectively to provide additional support in the lateral direction as the hook receiving portion is displaced between the locked and released positions thereof.

The stabilizer lugs 80 also provide an increased mass to the body of the actuator member at the connection of the hook receiving portion 70 to the arch 66 to reduce flexing of the arch relative to the hook receiving portion at the connection therebetween. The flexing of the arch is thus more concentrated at an intermediate location along the arch 66 where the dimensions of the arch can be used to control the biasing force provided by the arch for resisting displacement from the locked position to the released position and to bias the return of the hook receiving portion from the released position towards the locked position.

In the locked position, the innermost surfaces of the lugs 80 are substantially flush with the rear or longitudinal outer end boundary of the access openings 56 while the follower elements are closely abutted against the opposing end of the access openings at the inner end thereof. In this manner the hook receiving portion of the actuator member fully occupies the access openings in the locked position. As the hook receiving portion of the actuator member is displaced towards the released position, the follower elements are displaced along the access openings to the rear or longitudinal outer ends thereof.

A tool receiving recess opening 82 is provided within each of the follower elements such that the tool receiving recesses define a pair of sockets which are open laterally to the exterior of the holder at laterally opposing sides of the holder respectively. The tool receiving recess openings are aligned with one another along a common lateral axis and are internally open to one another to define a through tool opening suitable for receiving the elongated shaft of a tool therein either by insertion of the end of the tool partially into either end of the too opening or by insertion of the shaft of a tool extended fully through the tool opening formed by the pair of tool receiving recess openings 82.

By locating the tool receiving recess openings 82 within the follower elements 78, the openings 82 are aligned with the access openings 56 in the blade holder throughout the full movement of the hook receiving portion of the actuator member between the locked position and the released position thereof. The range of movement of the tool receiving recess openings 82 within the access openings in the blade holder allows a tool to be inserted for either assisting in releasing the assembly from the locked position, or for forcing the tool into the locked position if the wedging of the hook retaining surface 74 under the lower face of the hook portion 48 is tight and requires more force to close than provided by the biasing of the actuating member 24 alone.

The outer end face of each follower element is recessed laterally inwardly in relation to the side surface of the blade holder about the full perimeter of the access opening such that the follower element is difficult to access with the fingers of an operator. Typically, the actuator member is operated using a tool having an elongated shaft such as a screwdriver or an awl which can be inserted through the tool receiving recesses 82 by insertion through the access openings 56. The operator then applies pressure to the tool to displace the hook receiving portion of the actuator member against the biasing of the spring formed by the arch 66 of the actuator member until the second hook is unobstructed by the hook receiving portion of the actuator member so that the second hook can be released from the blade holder. Continuing to pivot the skate blade about an axis centred relative to the curvature of the first hook and corresponding recess enables the first hook to be withdrawn from the first recess and the blade holder to fully release the blade therefrom.

To insert a replacement blade, the first hook of the replacement blade is aligned with the first recess of the blade holder, followed by pivoting of the blade about an axis centred on the arc of the first hook until the second hook is aligned with the bottom opening 52 of the second pedestal. An upper surface of the hook portion 48 of the second hook is sloped upwardly and inwardly so that upon engagement with the inner end of the hook receiving portion of the actuator member, the continued upward movement of the second hook into the bottom opening of the blade holder causes the hook receiving portion of the actuator member to slide along the upper surface of the hook portion 48 to urge the hook receiving portion outwardly from the locked position towards the released position sufficiently for the free end of the second hook to clear the inner end of the actuator member. Continued upward movement of the second hook into the bottom opening in the second pedestal results in the positioning of the lower hooking surface of the second hook moving upwardly to a position above the inner end of the hook receiving portion of the actuator member so that the biasing of the actuator member returns the hook receiving portion to the locked position below the hooking surface of the second hook.

The inner end of the hook receiving portion of the actuator member is shown to be rounded and generally semi-circular in shape between the bottom surface that rides on the lower ledge and the top surface defining the hook retaining surface thereon for ease in sliding movement of the actuator member and the second hook relative to one another between locked and released positions thereof.

The actuator member in the illustrated embodiment is formed as a single, seamless, unitary body having a unitary material throughout. A suitable material is selected to provide the required degree of resilience to the single arch 66 so that the spring force alone is sufficient to bias the actuator member into the locked position upon insertion of a blade into the holder. Typically, the biasing force is also sufficiently strong that it would be difficult for a person to access and deflect the actuator member from the locked position to the released position without the use of a tool inserted through the tool receiving openings 82 in the actuator member.

The blade holder may also be moulded as a single, seamless, unitary body. The blade holder is preferably formed of a suitably rigid material to provide adequate support to the skate blade and to retain the skate blade in fixed relation to the skate boot in the locked position of the actuator member.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An ice skate blade assembly for a skate, the ice skate blade assembly extending along a longitudinal axis and comprising:

an ice skate blade having first and second ends of the blade, an ice-contacting surface extending in a direction of the longitudinal axis between the first and second ends, and an upper edge opposite to the ice-contacting surface, the upper edge comprising first and second hooks projecting upwardly proximate to one of the first and second ends respectively;

a blade holder having first and second pedestals and a bridge portion connecting the first and second pedestals, the blade holder further comprising a bottom portion having a longitudinal groove extending thereal-long for receiving the upper edge of the ice skate blade, the bottom portion further defining a hook-receiving recess extending upwardly from the longitudinal groove for receiving the first hook of the ice skate blade and wherein the second pedestal has an inner surface defining a cavity with a bottom aperture that opens to the longitudinal groove; and an actuator member at least partially mounted within the cavity of the second pedestal, the actuator member having a hook-receiving portion defining a hook retaining surface thereon, the hook-receiving portion being slidably movable along a sliding path between (i) a locked position, in which the hook retaining surface retains a hooking surface of the second hook of the ice skate blade thereon to lock the ice skate blade in the longitudinal groove of the blade holder, and (ii) a released position, in which the hook retaining surface does not obstruct movement of the second hook of the ice skate blade away from the blade holder to release the ice skate blade from the blade holder;

an end portion of the sliding path of the hook-receiving portion of the actuator member that is adjacent the locked position being oriented parallel to said longitudinal axis of the ice skate blade assembly; and the hook retaining surface of the hook-receiving portion of the actuator member being oriented parallel to said longitudinal axis of the ice skate blade assembly in the locked position.

2. The assembly according to claim 1 wherein the hook retaining surface is oriented to perpendicularly intersect an imaginary arc that is centred at the first hook.

3. The assembly according to claim 1 further comprising a lower ledge formed on the blade holder, the lower ledge being oriented parallel to the end portion of the sliding path and supporting the hook-receiving portion of the actuator member engaged thereon for sliding movement between the locked and released positions, wherein one end of the lower ledge and a free end of the second hook are aligned with one another along an imaginary axis which is substantially perpendicular to said longitudinal axis of the ice skate blade assembly.

4. The assembly according to claim 1 further comprising at least one follower element defining a follower surface protruding laterally from the hook-receiving portion of the actuator member and a lateral ledge formed on the blade holder in association with said at least one follower element in which the lateral ledge is oriented parallel to the end portion of the sliding path and supports the follower surface of the follower element thereon for sliding movement between the locked and released positions.

5. The assembly according to claim 4 wherein said at least one follower element is located at one end of the hook-receiving portion of the actuator member.

6. The assembly according to claim 4 wherein the lateral ledge associated with said at least one follower element is formed along a peripheral edge of an access opening in the blade holder which is open laterally to an exterior of the blade holder.

7. The assembly according to claim 6 wherein the access opening associated with said at least one follower element is a longitudinally extending slot and wherein the follower element occupies substantially a full height of the slot.

8. The assembly according to claim 4 wherein said at least one follower element comprises a pair of follower elements protruding outwardly from laterally opposing sides of the hook-receiving portion of the actuator member.

9. The assembly according to claim 1 wherein the recess in the blade holder which receives the first hook is curved along a first arc and the first hook is curved along a second arc identical to the first arc such that the first hook is matingly received into the recess by pivoting of the blade relative to blade holder about a center of the first and second arcs.

10. The assembly according to claim 1 further comprising at least one access opening in the blade holder which is open laterally to an exterior of the blade holder through which the actuator member is accessed for displacing the actuator member between the locked and released positions, the hook retaining surface of the second hook being located above at least a portion of said at least one access opening.

11. The assembly according to claim 10 wherein said at least one access opening overlaps the hook retaining surface of the second hook in a direction of the longitudinal axis.

12. The assembly according to claim 10 wherein said at least one access opening in the blade holder is fully occupied by the actuator member in the locked position.

13. The assembly according to claim 10 wherein the hook-receiving portion of the actuator member includes a tool-receiving recess extending laterally inwardly from a side surface of the actuator member so as to be adapted to receive the end of a laterally oriented tool member therein, the tool-receiving recess being aligned with said at least one access opening throughout a range of movement of the hook-receiving portion of the actuator member between the locked and released positions thereof.

14. The assembly according to claim 13 wherein said at least one access opening comprises a pair of access openings at laterally opposing sides of the blade holder and wherein the tool-receiving recess comprises a through-hole extending perpendicularly to the longitudinal axis in alignment with the pair of access openings at opposing ends of the through-hole throughout a range of movement of the hook-receiving portion of the actuator member between the locked and released positions thereof.

15. The assembly according to claim 1 wherein the actuator member consists of:

(i) the hook-receiving portion; and (ii) a single spring member in the shape of an arch between a first end fixedly coupled to the blade holder and a second end fixedly coupled to the hook-receiving portion of the actuator member such that the spring member biases the hook-receiving portion from the released position to the locked position.

16. The assembly according to claim 1 wherein the sliding path is curved so as to extend longitudinally from the end portion adjacent the locked position along an upward curvature.

17. An ice skate blade assembly for a skate, the ice skate blade assembly extending along a longitudinal axis and comprising:

an ice skate blade having first and second ends of the blade, an ice-contacting surface extending in a direction of the longitudinal axis between the first and second ends, and an upper edge opposite to the ice-contacting surface, the upper edge comprising first and second hooks projecting upwardly proximate to one of the first and second ends respectively;

a blade holder having first and second pedestals and a bridge portion connecting the first and second pedestals, the blade holder further comprising a bottom portion having a longitudinal groove extending therealong for receiving the upper edge of the ice skate blade, the bottom portion further defining a hook-receiving recess extending upwardly from the longitudinal groove for receiving the first hook of the ice skate blade and wherein the second pedestal has an inner surface defining a cavity with a bottom aperture that opens to the longitudinal groove; and an actuator member at least partially mounted within the cavity of the second pedestal, the actuator member having a hook-receiving portion defining a hook retaining surface thereon, the hook-receiving portion being slidably movable along a sliding path between (i) a locked position, in which the hook retaining surface retains a hooking surface of the second hook of the ice skate blade thereon to lock the ice skate blade in the longitudinal groove of the blade holder, and (ii) a released position, in which the hook retaining surface does not obstruct movement of the second hook of the ice skate blade away from the blade holder to release the ice skate blade from the blade holder;

the blade holder including at least one access opening therein which is open laterally to an exterior of the blade holder through which the actuator member is accessed for displacing the actuator member between the locked and released positions;

the hook retaining surface of the second hook being located above at least a portion of said at least one access opening.

18. The assembly according to claim 17 wherein said at least one access opening overlaps the hook retaining surface of the second hook in a direction of the longitudinal axis.

19. The assembly according to claim 17 wherein the hook-receiving portion of the actuator member includes a tool-receiving recess extending laterally inwardly from a side surface of the actuator member so as to be adapted to receive the end of a laterally oriented tool member therein, the tool-receiving recess being aligned with said at least one access opening throughout a range of movement of the hook-receiving portion of the actuator member between the locked and released positions thereof.

20. An ice skate blade assembly for a skate, the ice skate blade assembly extending along a longitudinal axis and comprising:

an ice skate blade having first and second ends of the blade, an ice-contacting surface extending in a direction of the longitudinal axis between the first and second ends, and an upper edge opposite to the ice-contacting surface, the upper edge comprising first and second hooks projecting upwardly proximate to one of the first and second ends respectively;

a blade holder having first and second pedestals and a bridge portion connecting the first and second pedestals, the blade holder further comprising a bottom portion having a longitudinal groove extending therealong for receiving the upper edge of the ice skate blade, the bottom portion further defining a hook-receiving recess extending upwardly from the longitudinal groove for receiving the first hook of the ice skate blade and wherein the second pedestal has an inner surface defining a cavity with a bottom aperture that opens to the longitudinal groove; and an actuator member at least partially mounted within the cavity of the second pedestal, the actuator member having a hook-receiving portion defining a hook retaining surface thereon, the hook-receiving portion being slidably movable along a sliding path between (i) a locked position, in which the hook retaining surface retains a hooking surface of the second hook of the ice skate blade thereon to lock the ice skate blade in the longitudinal groove of the blade holder, and (ii) a released position, in which the hook retaining surface does not obstruct movement of the second hook of the ice skate blade away from the blade holder to release the ice skate blade from the blade holder;

the actuator member having at least one follower element defining a laterally protruding follower surface laterally from the hook-receiving portion of the actuator member; and the blade holder having a lateral ledge formed thereon in association with said at least one follower element in which the lateral ledge (i) is oriented parallel to an end portion of the sliding path of the hook-receiving portion of the actuator member that is adjacent the locked position and (ii) supports the follower surface of the follower element thereon for sliding movement between the locked and released positions.

21. The assembly according to claim 20 wherein said at least one follower element is located at one end of the hook-receiving portion of the actuator member.

22. An ice skate blade assembly for a skate, the ice skate blade assembly extending along a longitudinal axis and comprising:

an ice skate blade having first and second ends of the blade, an ice-contacting surface extending in a direction of the longitudinal axis between the first and second ends, and an upper edge opposite to the ice-contacting surface, the upper edge comprising first and second hooks projecting upwardly proximate to one of the first and second ends respectively;

a blade holder having first and second pedestals and a bridge portion connecting the first and second pedestals, the blade holder further comprising a bottom portion having a longitudinal groove extending therealong for receiving the upper edge of the ice skate blade, the bottom portion further defining a hook-receiving recess extending upwardly from the longitudinal groove for receiving the first hook of the ice skate blade and wherein the second pedestal has an inner surface defining a cavity with a bottom aperture that opens to the longitudinal groove; and an actuator member at least partially mounted within the cavity of the second pedestal, the actuator member having a hook-receiving portion defining a hook retaining surface thereon, the hook-receiving portion being slidably movable along a sliding path between (i) a locked position, in which the hook retaining surface retains a hooking surface of the second hook of the ice skate blade thereon to lock the ice skate blade in the longitudinal groove of the blade holder, and (ii) a released position, in which the hook retaining surface does not obstruct movement of the second hook of the ice skate blade away from the blade holder to release the ice skate blade from the blade holder;

the sliding path of the hook-receiving portion of the actuator member being curved so as to extend longitudinally from a first end portion adjacent the locked position along an upward curvature towards an opposing second end portion adjacent to the released position.

23. The assembly according to claim 22 wherein the first end portion of the sliding path is oriented parallel to said longitudinal axis of the ice skate blade assembly.

* * * * *